United States Patent [19]

Uchida et al.

[11] 4,262,896

[45] Apr. 21, 1981

[54] SUCTION HEAD IN A PAPER SHEET COUNTING MACHINE

[75] Inventors: Isamu Uchida; Akira Hirata, both of Tokyo, Japan

[73] Assignee: Laurel Bank Machine Co., Ltd., Tokyo, Japan

[21] Appl. No.: 61,036

[22] Filed: Jul. 26, 1979

[30] Foreign Application Priority Data

Jul. 27, 1978 [JP] Japan ..... 53-103809[U]

[51] Int. Cl.[3] ..... B65H 5/10

[52] U.S. Cl. ..... 271/90; 271/107

[58] Field of Search ..... 271/90–108; 414/416, 121, 128, 380; 221/211

[56] References Cited

U.S. PATENT DOCUMENTS

| | | | |
|---|---|---|---|
| 2,392,403 | 1/1946 | Pechy | 271/102 |
| 2,976,037 | 3/1961 | Seel | 271/103 |
| 3,087,722 | 4/1963 | Neuberger | 271/107 |
| 3,155,386 | 11/1964 | Burleigh | 271/100 |
| 3,272,549 | 9/1966 | Nisala | 271/90 |
| 3,797,822 | 3/1974 | Anderso | 271/107 |

*Primary Examiner*—Robert B. Reeves
*Assistant Examiner*—Brian Bond
*Attorney, Agent, or Firm*—Fleit & Jacobson

[57] ABSTRACT

A suction head is provided in a paper sheet counting machine in which a number of paper sheets contained in a container box are vacuum-sucked one at a time to be taken out of the container box and be counted. The suction head has a suction port into which a suction port member is threaded. The suction port member is integral with a suction contact member made of a rubber which contacts a paper sheet to be taken out.

4 Claims, 6 Drawing Figures

FIG. 1
(PRIOR ART)
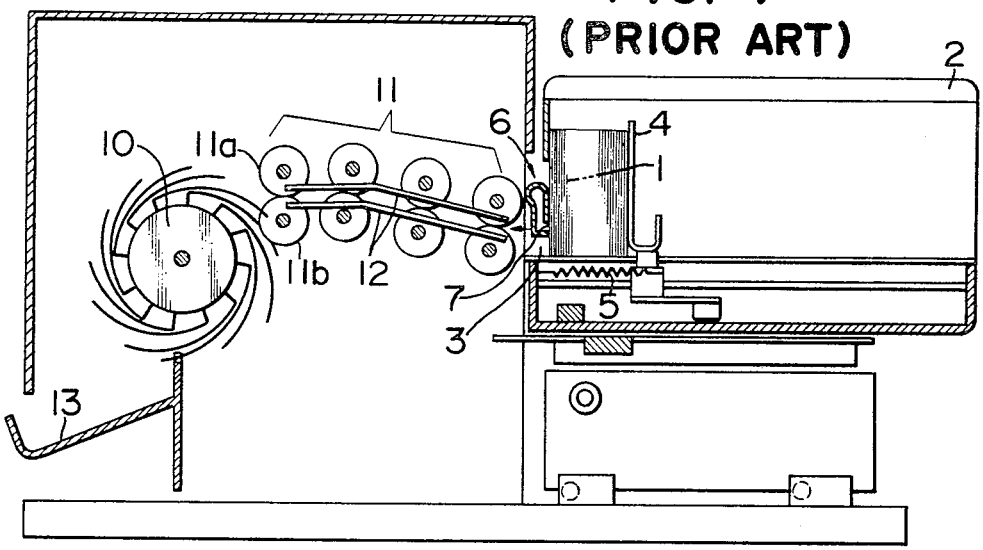
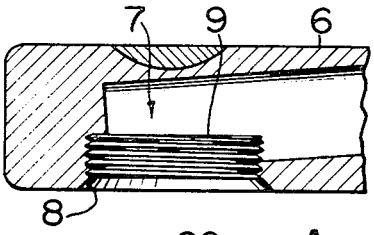
FIG. 3
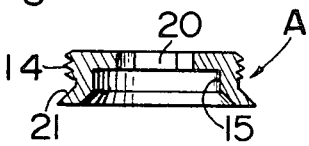
FIG. 4
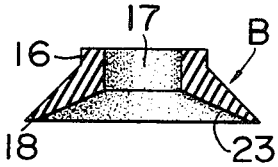
FIG. 5
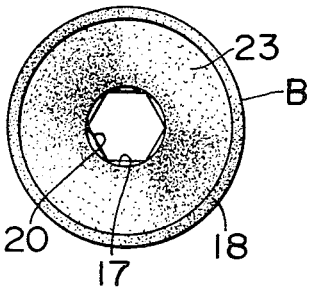
FIG. 6

SUCTION HEAD IN A PAPER SHEET COUNTING MACHINE

BACKGROUND OF THE INVENTION

The present invention relates to a suction head in a paper sheet counting machine. More particularly, the invention relates to the structure of the lower end portion of such suction head.

The conventional suction head has only a suction port at the lower end thereof and, therefore, cannot positively grasp paper sheets, particularly a paper sheet having an uneven and irregular surface.

SUMMARY OF THE INVENTION

The present invention provides an improved suction head of the reciprocative rotation type for a paper sheet counting machine, in which paper sheets contained in a container box are vacuum-sucked one by one by the suction head and they are thus taken out from the container box and counted. The suction head of the present invention is constructed so that even a paper sheet having an uneven and irregular surface can be attracted to the suction head through an attachment assuredly. This attachment has a good durability and may easily be exchanged with other attachment without any particular adjustment, and thus the exchange operation can be conducted very smoothly and conveniently by a simple structure.

According to the present invention, there is provided a suction head for a paper sheet counting machine in which a number of paper sheets contained in a container box are vacuum-sucked one at a time by the suction head of the reciprocative rotation type and the sucked sheets are taken out and counted, characterized in that said suction head comprises a suction port member and a flexible suction contact member integral therewith, said suction port member having a portion adapted to be screwed into the suction head at the lower end side thereof and an angular suction hole which helps the mounting and demounting of the attachment, said suction contact member having a frustoconical portion adapted to be engageable with the paper sheets.

BRIEF DESCRIPTION OF THE DRAWINGS

Other objects and advantages of the present invention will become apparent from the following description made with reference to the accompanying drawings, in which:

FIG. 1 is a sectional view illustrating the major part of a conventional counter for paper sheets;

FIG. 3 is an enlarged sectional view illustrating a lower portion of the suction head;

FIG. 4 is a sectional view illustrating a suction port member;

FIG. 5 is a sectional view illustrating a suction contact member; and

FIG. 6 is a plan view illustrating the state where the suction contact member is rigidly attached to the suction port member.

DETAILED DESCRIPTION OF THE PREFERRED EMBODIMENT OF THE INVENTION

Figure 2:
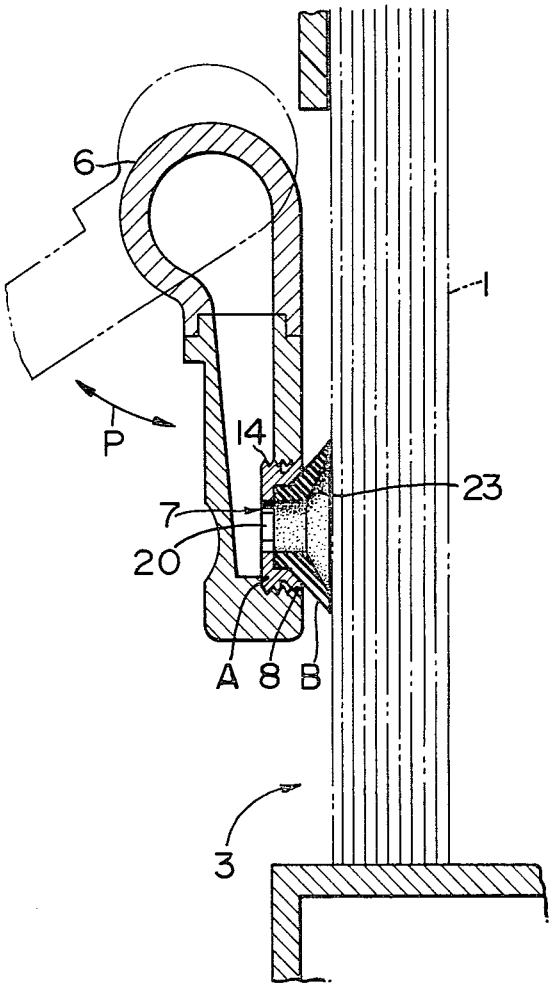
FIG. 2 is a sectional view illustrating the major part of a suction head according to one embodiment of the present invention.

One embodiment of the present invention will now be described in detail with the reference to the accompanying drawings.

A conventional paper sheet counting machine will be first explained with reference to the FIG. 1. A take-out opening 3 is formed on one end side of a container box 2 for containing paper sheets 1 such as bills therein, and a movably mounted press plate 4 is pulled by a tension spring 5 so that the paper sheets 1 are pressed toward the take-out opening 3 by the press plate 4. A hollow suction head 6 is mounted on the take-out opening 3 so that the suction head can be reciprocatively turned and paper sheets 1 are sucked through this suction head 6 by a vacuum suction pump. A suction port 7 is formed on the lower end side of the suction head 6. A plurality of pairs of rollers 11, each pair consisting of an upper roller 11*a* and a lower roller 11*b*, are laid out downstream of the suction head 6 and guide rails 12 for the paper sheets 1 are arranged between the upper rollers 11*a* and the lower rollers 11*b*. An accumulation wheel 10 is supported through a shaft on the terminal portion of the rollers 11 and a delivery port 13 is disposed below the accumulation wheel 10. A conventional paper sheet counting machine has the above-mentioned structure. The suction head 6 shown in FIG. 1 is a conventional suction head. That is, the suction head 6 is provided at the lower end side thereof with the suction port 7 and has no attachment.

Referring to FIGS. 2 to 6 illustrating one embodiment of the present invention, a hollow suction head 6 has a suction port 7 in which a female thread 9 is provided at the inner portion and a tapered portion 8 at the outer end thereof. An attachment which comprises a suction port member A made integral with a suction contact member B by heat welding, adhesive or any other means, which will be described in detail hereinafter, is remarkably attached to the suction head 6.

A male thread 14 to be engaged with the female thread 9 is formed on the peripheral face of one end side of the suction port member A and a hexagonal suction hole 20 is formed in the interior thereof. A recess 15 having a stepped configuration is formed in the interior of a frustoconical portion 21 on the other end side of the suction port member A, so that the frustoconical portion 21 becomes engaged with the tapered portion 8.

A fitting portion 16 is formed on the end of a frustoconical portion 23 of the suction contact member B composed of rubber so that the recess 15 can be fitted under compression onto the fitting portion 16. The frustoconical portion 23 is constructed so that an outer end face 18 of the frustoconical portion 23 is a uniform circular edge face and the peripheral face of the frustoconical portion 23 on the base side can be engaged with the inner circumferential face of the above-mentioned frustoconical portion 21.

Therefore, after the suction contact member B is fitted into the suction port member A, these members are made integral with each other by heat welding, or before the suction contact member B is fitted into the suction port member A, an adhesive is attached to the circumferential surface of the fitting portion of the suction contact member B and, thereafter, the suction contact member B is adhesive is fitted into the suction port member A to be made integral.

On the basis of the above construction of the attachment comprising the suction port member A and the suction contact member B, the attachment has a very important feature that it does not lose a flexability for a very long time and, therefore, no replacement or repair is required for a long time. This may be due to the fact that (1) the suction port member A rigidly backs up the suction contact member B at the fitting portion thereof when the suction contact member 13 is pressure contacted with the paper sheet to be sucked, (2) the integrality of the suction port member A and the suction contact member B tends to maintain the original configuration of the suction contact member B and (3) the frustoconical portion 23 of the suction contact member B is made to be smaller toward the outer end face 18.

The attachment is attached to the suction head 6 in the following manner.

The male thread 14 of the suction port member A is registered with the female thread 9 of the suction head 6. In this state, a tool is inserted in the hexagonal hole of the suction hole portion 20, and the attachment is screwed by turning the tool until the outer face of the frustoconical portion 21 is engaged with the inner face of the tapered portion 8. The removal of the attachment is made easily in a reversed operation.

In operation, when the suction head 6 is reciprocatively turned as indicated by arrow P as in the conventional technique, the outer end face 18 of the frustoconical portion 23 of the suction contact member B is caused to fall in contact with the face of a paper sheet 1, and paper sheets 1 are vacuum sucked, taken out and counted one by one and they are transferred to the delivery port 13 by means of the rollers 11.

What is claimed is:

1. A combined suction head, suction port member, and suction contact member for use with a paper sheet counting machine, the paper sheet counting machine comprising a container box for holding paper sheets and a reciprocative rotation type suction head for vacuum-sucking sheets contained in the box and for taking sucked sheets out of the box one at a time for counting;

said suction head having a suction port defined therein with an inner threaded portion and an outer portion tapered from the inner threaded portion to an outer surface of said suction head;

said suction port member having a bore formed therein with an innermost portion of the bore having an angular configuration, a middle portion of the bar having a cylindrical configuration, and an outer portion of the bore having an outwardly tapered configuration, a first portion of an outer peripheral surface of said suction port member being threaded and a second portion having a taper corresponding with the taper of the outer portion of said suction head so that said suction port member is positioned in and threadedly connected to said suction head; and said suction contact member being made of a flexible material and having an internal bore with an outwardly tapered outer portion and having an external configuration corresponding to the shape of the middle and outer portions of the bore formed in said suction port member, said suction contact member being positioned in said bore in said suction port member and rigidly connected to said suction port member with the peripheral portion of said suction contact member containing said tapered outer portion of the bore being directly contacted and supported by portions of said suction port member.

2. The invention of claim 1, wherein the innermost portion of the bore of said suction port member has a hexagonal configuration.

3. The invention of claim 1, wherein said suction contact member has an external configuration larger than the bore in said suction port member so that said suction contact member is compressed when inserted into said suction port member.

4. The invention of claims 1, 2, or 3, wherein said suction contact member has a frustoconical portion with a uniform circular edge face for contacting sheets to be sucked.

* * * * *